US011384766B2

(12) United States Patent
Iwakiri

(10) Patent No.: US 11,384,766 B2
(45) Date of Patent: Jul. 12, 2022

(54) DIFFUSER VANE GEOMETRY FOR A CENTRIFUGAL COMPRESSOR AND TURBOCHARGER

(71) Applicant: MITSUBISHI HEAVY INDUSTRIES, LTD., Tokyo (JP)

(72) Inventor: Kenichiro Iwakiri, Tokyo (JP)

(73) Assignee: MITSUBISHI HEAVY INDUSTRIES MARINE MACHINERY & EQUIPMENT CO., LTD., Nagasaki (JP)

( * ) Notice: Subject to any disclaimer, the term of this patent is extended or adjusted under 35 U.S.C. 154(b) by 228 days.

(21) Appl. No.: 16/629,791

(22) PCT Filed: Nov. 22, 2018

(86) PCT No.: PCT/JP2018/043184
§ 371 (c)(1),
(2) Date: Jan. 9, 2020

(87) PCT Pub. No.: WO2019/111725
PCT Pub. Date: Jun. 13, 2019

(65) Prior Publication Data

US 2021/0372410 A1 Dec. 2, 2021

(30) Foreign Application Priority Data

Dec. 6, 2017 (JP) ..... JP2017-234127

(51) Int. Cl.
*F04D 17/10* (2006.01)
*F04D 29/44* (2006.01)
*F04D 29/42* (2006.01)

(52) U.S. Cl.
CPC ..... *F04D 17/10* (2013.01); *F04D 29/4213* (2013.01); *F04D 29/441* (2013.01); *F05D 2220/40* (2013.01)

(58) Field of Classification Search
CPC .... F04D 17/10; F04D 29/4213; F04D 29/441; F05D 2220/40
(Continued)

(56) References Cited

U.S. PATENT DOCUMENTS

2010/0178163 A1 7/2010 Dettmann et al.
2012/0294711 A1 11/2012 Grigoriev et al.
(Continued)

FOREIGN PATENT DOCUMENTS

CN 107061321 A * 8/2017
EP 2623793 A1 8/2013
(Continued)

OTHER PUBLICATIONS

International Search Report dated Feb. 12, 2019, issued in counterpart Application No. PCT/JP2018/043184 (9 pages).
(Continued)

*Primary Examiner* — J. Todd Newton
(74) *Attorney, Agent, or Firm* — WHDA, LLP

(57) ABSTRACT

A centrifugal compressor includes an impeller, a plurality of diffuser vanes arranged in a circumferential direction on a radially outer side of the impeller, and a housing which includes a scroll portion forming a scroll flow passage positioned on a radially outer side of the plurality of diffuser vanes. The plurality of diffuser vanes include at least one first diffuser vane positioned in an angular range between a tongue section of the scroll portion and a scroll end of the scroll portion in the circumferential direction, and a second diffuser vane positioned outside the angular range. A vane outlet angle formed by a tangent line at a trailing edge to a pressure surface of each of the plurality of diffuser vanes satisfies $\beta 1<\beta 2$, where $\beta 1$ is the vane outlet angle of the first diffuser vane, and $\beta 2$ is the vane outlet angle of the second diffuser vane.

9 Claims, 7 Drawing Sheets

(58) Field of Classification Search
USPC ..... 60/605.1
See application file for complete search history.

(56) References Cited

U.S. PATENT DOCUMENTS

| | | | | |
|---|---|---|---|---|
| 2013/0202444 | A1 | 8/2013 | Wunderer | |
| 2016/0281734 | A1 | 9/2016 | Musgrave et al. | |
| 2017/0152861 | A1* | 6/2017 | Japikse | F04D 17/10 |
| 2018/0306203 | A1* | 10/2018 | Nasir | F02C 6/12 |

FOREIGN PATENT DOCUMENTS

| | | | | |
|---|---|---|---|---|
| JP | 2004124715 | A | * | 4/2004 |
| JP | 2008-215250 | A | | 9/2008 |
| JP | 2008215250 | A | * | 9/2008 |
| JP | 2010-529358 | A | | 8/2010 |
| JP | 2013-519036 | A | | 5/2013 |
| JP | 2014-202102 | A | | 10/2014 |
| KR | 10-2012-0125483 | A | | 11/2012 |

OTHER PUBLICATIONS

International Preliminary Report on Patentability dated Jun. 18, 2020, issued in counterpart International Application Mo. PCT/JP2018/043184, with English translaiton (14 pages).
Office Action dated Oct. 23, 2019, issued in counterpart JP Application No. 2017-234127, with English translation (9 pages).
Office Action dated Apr. 21, 2020, issued in counterpart JP Application No. 2017-234127, with English translation (12 pages).
Office Action dated Jul. 3, 2020, issued in counterpart CN application No. 201880046024.7, with English translation. (14 pages).
Office Action dated Oct. 23, 2020, issued in counterpart KR application No. 10-2019-7035585, with English Translation. (9 pages).

* cited by examiner

DIFFUSER VANE GEOMETRY FOR A CENTRIFUGAL COMPRESSOR AND TURBOCHARGER

TECHNICAL FIELD

The present disclosure relates to a centrifugal compressor and a turbocharger.

BACKGROUND

As a centrifugal compressor applied to a turbocharger or the like, a centrifugal compressor may be used, which is provided with a diffuser vane for decreasing the velocity and increasing the pressure of a fluid downstream of an impeller for applying a centrifugal force to the fluid.

For example, Patent Document 1 discloses a centrifugal gas compressor which includes a plurality of diffuser vanes each configured to convert the flow velocity of a fluid from an impeller into a pressure and a scroll for guiding the flow of the fluid from the diffuser vanes to the outside. In the centrifugal gas compressor, in order to improve efficiency of a diffuser, the plurality of diffuser vanes are arranged as an asymmetrical pattern in the circumferential direction of the fluid in the scroll in consideration of a pressure distribution in the circumferential direction. That is, the shapes, the orientations, or the positions of the plurality of diffuser vanes arranged in the circumferential direction are not uniform.

CITATION LIST

Patent Literature

Patent Document 1: JP2013-519036A (translation of a PCT application)

SUMMARY

Technical Problem

Meanwhile, in a centrifugal compressor with a diffuser vane, the shape of a flow passage changes from a spiral shape to a linear shape in the vicinity of the outlet of a scroll flow passage, and thus a circumferential component of a flow velocity decreases in an angular range in the vicinity of the outlet of the scroll flow passage in the circumferential direction as compared with another angular range. Accordingly, the flow stalls on a pressure surface of the diffuser vane (negative stall), which may cause separation.

In this regard, in the centrifugal gas compressor described in Patent Document 1, although the plurality of diffuser vanes are arranged as the asymmetrical pattern in consideration of the pressure distribution in the circumferential direction, Patent Document 1 does not disclose a specific configuration for suppressing separation of the flow in the diffuser vanes in the vicinity of the outlet of the scroll flow passage.

In view of the above, an object of at least one embodiment of the present disclosure is to provide a centrifugal compressor and a turbocharger including the same. The centrifugal compressor can suppress separation of a flow in diffuser vanes in an angular range in the vicinity of the outlet of a scroll flow passage.

Solution to Problem (1) A centrifugal compressor according to at least one embodiment of the present invention includes an impeller, a plurality of diffuser vanes arranged in a circumferential direction on a radially outer side of the impeller, and a housing which includes a scroll portion forming a scroll flow passage positioned on a radially outer side of the plurality of diffuser vanes. The plurality of diffuser vanes include at least one first diffuser vane positioned at least partially in an angular range between a tongue section of the scroll portion and a scroll end of the scroll portion in the circumferential direction, and a second diffuser vane positioned outside the angular range. A vane outlet angle formed by a tangent line at a trailing edge to a pressure surface of each of the plurality of diffuser vanes satisfies $\beta 1<\beta 2$, where $\beta 1$ is the vane outlet angle of the first diffuser vane, and $\beta 2$ is the vane outlet angle of the second diffuser vane.

As described above, in the angular range between the tongue section of the scroll portion and the scroll end of the scroll portion in the circumferential direction (that is, an angular range in the vicinity of the outlet of the scroll flow passage), a flow stalls on the pressure surface of each of the diffuser vanes (negative stall), which may cause separation. This is considered because in the angular range in the vicinity of the outlet of the scroll flow passage, the flow direction of a fluid is turned, and a circumferential component of a flow velocity is decreased as compared with another angular range, and thus an effect of pressing a flow in the vicinity of each of the diffuser vanes against the pressure surface thereof is small.

In this regard, with the above configuration (1), since the vane outlet angle $\beta 1$ of the first diffuser vane positioned in the angular range in the vicinity of the outlet of the scroll flow passage where the circumferential component of the flow velocity decreases is smaller than the vane outlet angle $\beta 2$ of the second diffuser vane positioned outside the angular range, the pressure surface in the vicinity of the trailing edge of the first diffuser vane is positioned upstream in the rotational direction of the impeller as compared with the second diffuser vane, making it possible to suppress separation on the side of the pressure surface of the first diffuser vane.

(2) In some embodiments, in the above configuration (1), on a linear vane-arrangement mapping of the plurality of diffuser vanes, a camber angle $\alpha 1$ of the first diffuser vane and a camber angle $\alpha 2$ of the second diffuser vane satisfy $\alpha 1>\alpha 2$.

A camber angle of each of the diffuser vanes is an angle between a tangent line at the leading edge and a tangent line at the trailing edge of a camber line of each of the diffuser vanes.

With the above configuration (2), since the camber angle $\alpha 1$ of the first diffuser vane is larger than the camber angle $\alpha 2$ of the second diffuser vane, the pressure surface of the first diffuser vane deviates upstream in an impeller rotational direction with reference to the leading edge, as compared with the second diffuser vane. Thus, it is possible to achieve the above configuration (1).

(3) In some embodiments, in the above configuration (1) or (2), a vane thickness $t1$ at the trailing edge of the first diffuser vane and a vane thickness $t2$ at the trailing edge of the second diffuser vane satisfy $t1>t2$.

With the above configuration (3), since the vane thickness $t1$ at the trailing edge of the first diffuser vane is larger than the vane thickness $t2$ at the trailing edge of the second diffuser vane, it is possible to deviate the pressure surface of the first diffuser vane upstream in the impeller rotational direction without greatly changing the position of the suction surface of the first diffuser vane, as compared with the second diffuser vane. Thus, it is possible to achieve the above configuration (1).

(4) In some embodiments, in any one of the above configurations (1) to (3), a stagger angle formed by a chordwise direction of each of the plurality of diffuser vanes with respect to the radial direction satisfies $\gamma 1<\gamma 2$, where $\gamma 1$ is the stagger angle of the first diffuser vane, and $\gamma 2$ is the stagger angle of the second diffuser vane.

The above-described stagger angle may be a stagger angle at the leading edge or the trailing edge of each of the diffuser vanes.

With the above configuration (4), since the stagger angle $\gamma 1$ of the first diffuser vane is smaller than the stagger angle $\gamma 2$ of the second diffuser vane, the pressure surface of the first diffuser vane deviates upstream in an impeller rotational direction with reference to the leading edge, as compared with the second diffuser vane. Thus, it is possible to achieve the above configuration (1).

(5) In some embodiments, in the above configuration (4), in a cross section orthogonal to an axial direction, the first diffuser vane has the same cross-sectional shape as the second diffuser vane.

Satisfying the magnitude relationship between the stagger angles $\gamma 1$ and $\gamma 2$ described in the above configuration (4), it is possible to achieve the above configuration (1) even if the first diffuser vane having a common cross-sectional shape with the second diffuser vane is adopted.

(6) A turbocharger according to at least one embodiment of the present invention includes the centrifugal compressor according to any one of the above configurations (1) to (5).

With the above configuration (6), since the vane outlet angle $\beta 1$ of the first diffuser vane positioned in the angular range in the vicinity of the outlet of the scroll flow passage where the circumferential component of the flow velocity decreases is smaller than the vane outlet angle $\beta 2$ of the second diffuser vane positioned outside the angular range, the pressure surface in the vicinity of the trailing edge of the first diffuser vane is positioned upstream in the rotational direction of the impeller as compared with the second diffuser vane, making it possible to suppress separation on the side of the pressure surface of the first diffuser vane.

Advantageous Effects

According to at least one embodiment of the present invention, a centrifugal compressor and a turbocharger including the same are provided. The centrifugal compressor can suppress separation of a flow in diffuser vanes in an angular range in the vicinity of the outlet of a scroll flow passage.

DETAILED DESCRIPTION

Embodiments of the present invention will now be described in detail with reference to the accompanying drawings. It is intended, however, that unless particularly identified, dimensions, materials, shapes, relative positions and the like of components described in the embodiments shall be interpreted as illustrative only and not intended to limit the scope of the present invention.

A centrifugal compressor according to embodiments to be described below is applicable to, for example, a turbocharger. However, the application of the centrifugal compressor is not limited to the turbocharger.

Figure 1:
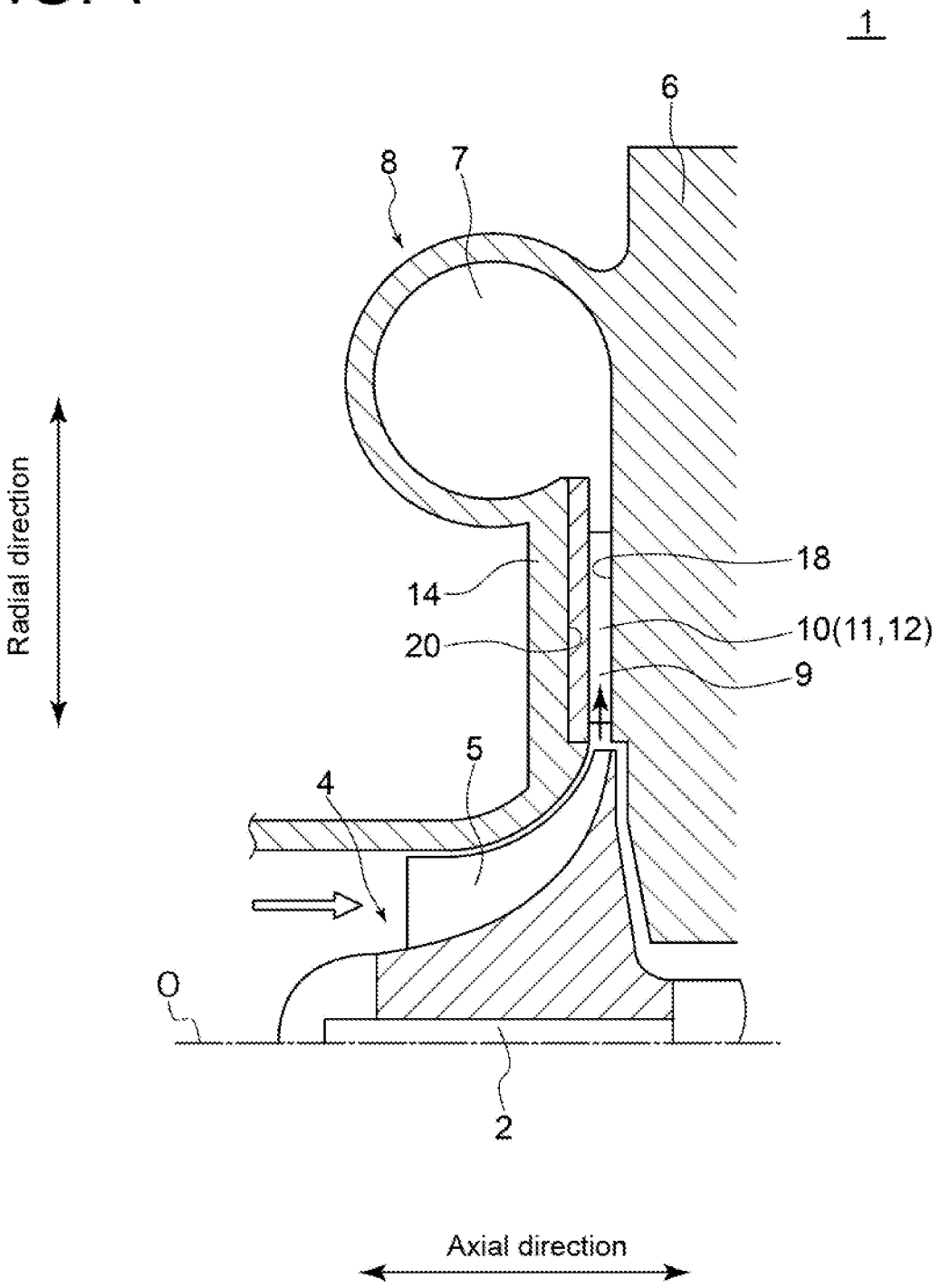
FIG. 1 is a schematic cross-sectional view of a centrifugal compressor along the axial direction according to an embodiment.
Figure 2A:
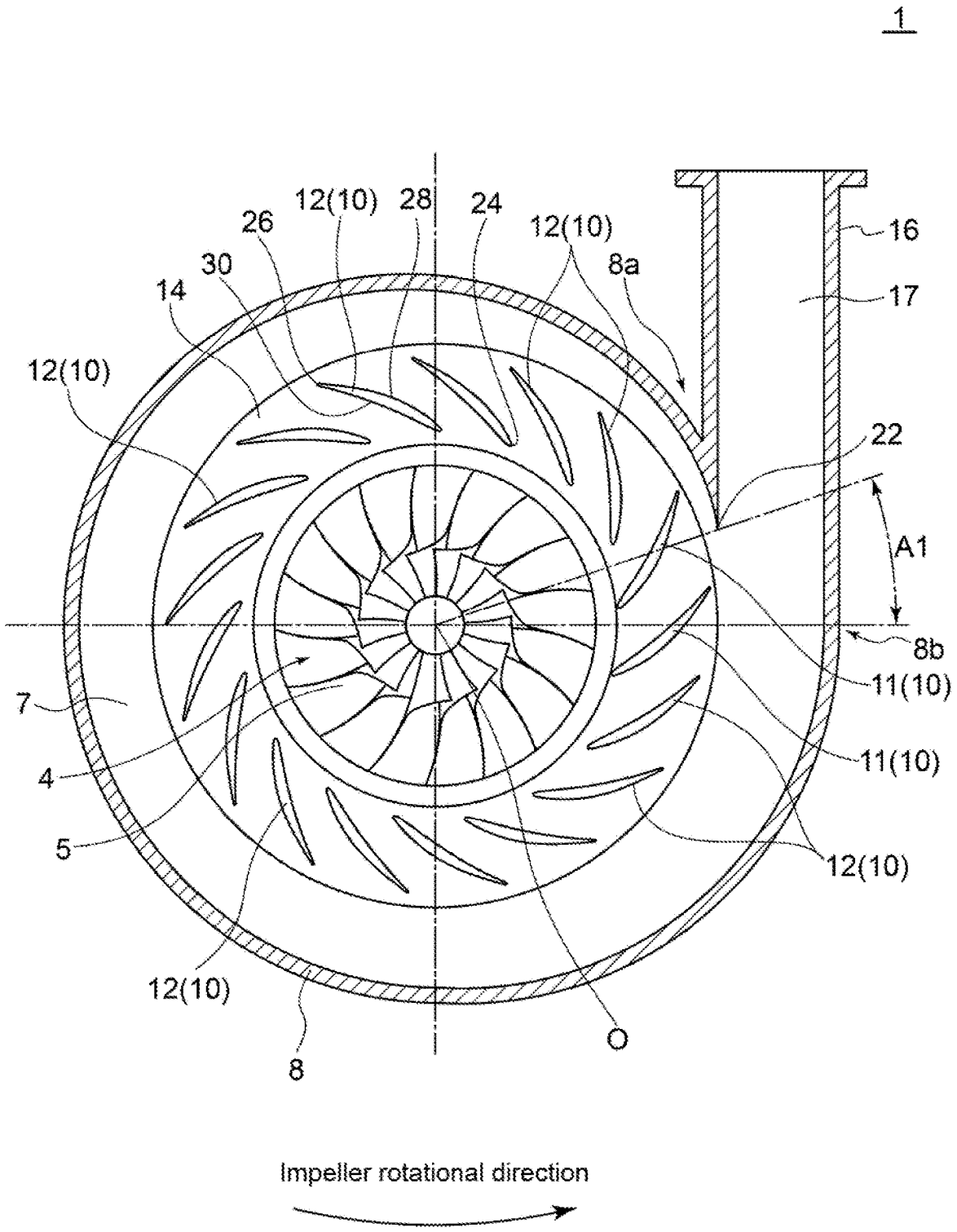
FIG. 2A is a view showing the interior of the centrifugal compressor shown in FIG. 1.
Figure 2B:
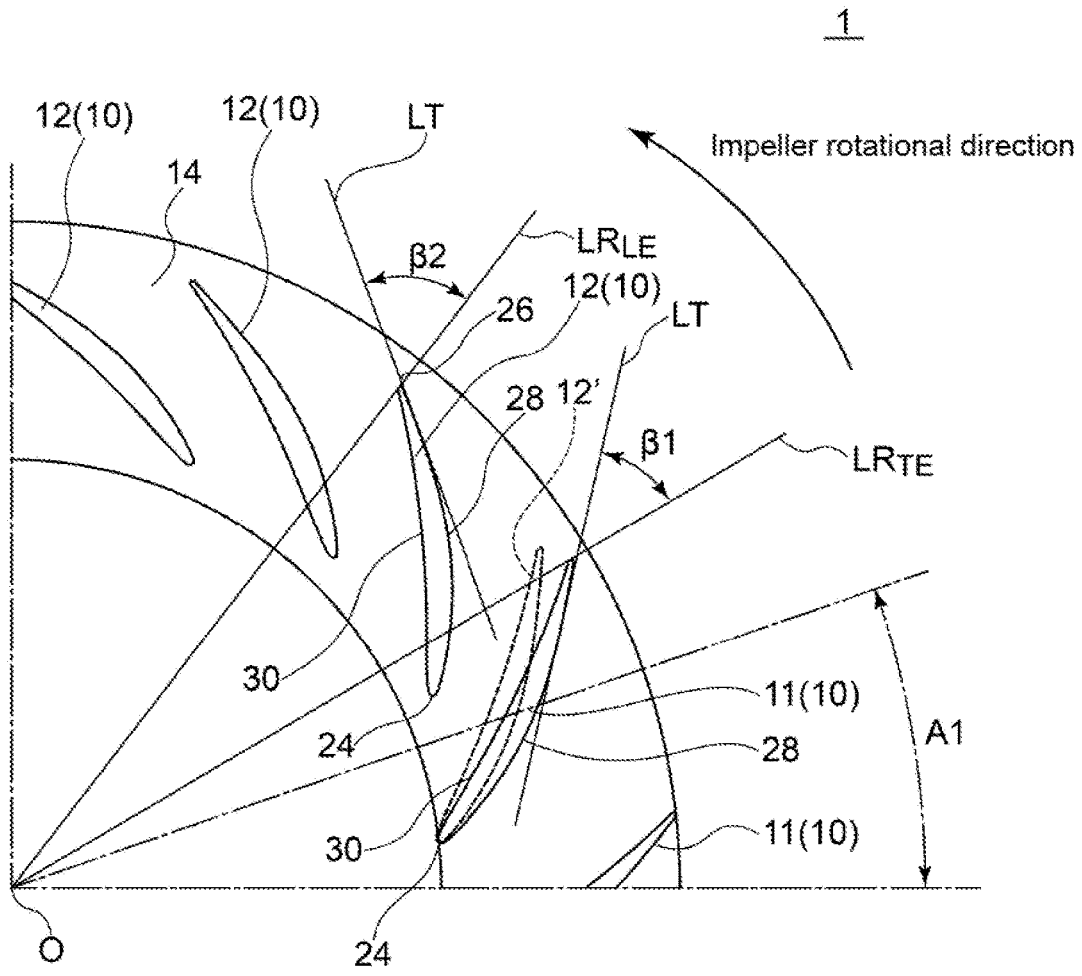
FIG. 2B is a partial enlarged view of FIG. 2A.

FIG. 1 is a schematic cross-sectional view of the centrifugal compressor along the axial direction according to an embodiment. FIGS. 2A and 2B are views for explaining the arrangement of components of the centrifugal compressor shown in FIG. 1. FIG. 2A is a view showing the interior of the centrifugal compressor shown in FIG. 1 as viewed from the axial direction. FIG. 2B is a partial enlarged view of FIG. 2A. In order to clarify the positional relationship among the respective components, each of the components is indicated by a solid line in FIG. 2A.

As shown in FIGS. 1 and 2A, a centrifugal compressor 1 according to an embodiment includes an impeller 4 and a housing 6. The impeller 4 includes a plurality of rotor blades 5 and can rotate about a rotational axis O with a rotational shaft 2. The housing 6 houses the impeller 4 and a plurality of diffuser vanes 10 to be described later.

On the outer side of the impeller 4 in the radial direction of the centrifugal compressor 1 (to be simply referred to as the "radial direction" hereinafter), a scroll flow passage 7 formed by a scroll portion 8 of the housing 6 is provided. As shown in FIG. 2A, the scroll flow passage 7 has a flow-passage cross-sectional area from a scroll start 8*a* to a scroll end 8*b* of the scroll portion 8, which gradually increases from upstream toward downstream in a rotational direction of the impeller 4 (that is, from upstream toward downstream in a flow direction of a fluid).

The scroll flow passage 7 communicates with an outlet flow passage 17 formed by an outlet portion 16 of the housing 6. In the housing 6, the scroll portion 8 and the outlet portion 16 are connected to each other, and a tongue section 22 is formed by a part of the scroll start 8*a* of the scroll portion 8 and the outlet portion 16 connected to the part of the scroll start 8*a*.

On the radially outer side of the impeller 4 and the radially inner side of the scroll flow passage 7, a diffuser passage 9 is formed by a hub-side wall surface 18 and a shroud-side wall surface 20 of the housing 6. In the diffuser passage 9, the plurality of diffuser vanes 10 are arranged in the circumferential direction of the centrifugal compressor 1 (to be simply referred to as the "circumferential direction" hereinafter). That is, the scroll flow passage 7 is positioned on the radially outer side of the diffuser passage 9 and the plurality of diffuser vanes 10.

Each of the plurality of diffuser vanes 10 has a leading edge 24, a trailing edge 26 positioned on the radially outer side of the leading edge 24, and a pressure surface 28 and a suction surface 30 extending between the leading edge 24 and the trailing edge 26.

The diffuser vanes 10 are installed in the above-described diffuser passage 9 while being fixed to the surface of a disc-shaped mounting plate 14. The diffuser vanes 10 may be joined to the mounting plate 14 by welding. Alternatively, the diffuser vanes 10 and the mounting plate 14 may integrally be formed by, for example, cutting work or the like.

In an illustrated example, the mounting plate 14 is installed on the shroud-side wall surface 20 forming the diffuser passage 9. However, in other embodiments, the mounting plate 14 may be installed on the hub-side wall surface 18.

In the centrifugal compressor 1, a fluid (such as a gas) flowing into the impeller 4 in the axial direction of the centrifugal compressor 1 (to be simply referred to as the "axial direction" hereinafter) is accelerated and pushed out in the circumferential direction and the radial direction due to the rotation of the impeller 4. The fluid accelerated by the impeller 4 passes through the diffuser vanes 10 disposed in the diffuser passage 9. At this time, kinetic energy of a fluid flow is converted into pressure energy (that is, the fluid is decreased in velocity and increased in pressure). Then, the flow passing through the diffuser vanes 10 and including a velocity component in the radial direction flows into the scroll flow passage 7 and is guided to the outlet flow passage 17 downstream thereof. The centrifugal compressor 1 thus generates a high-pressure fluid.

In the centrifugal compressor 1 according to some embodiments, the plurality of diffuser vanes 10 include first diffuser vanes 11 and second diffuser vanes 12 having different vane outlet angles β.

FIG. 2B is a view showing the diffuser vanes 10 in the vicinity of the outlet of the scroll flow passage 7 of the centrifugal compressor 1 shown in FIG. 2A. Each of the vane outlet angles β of a corresponding one of the diffuser vanes 10 is an angle formed by a tangent line LT at the trailing edge 26 to the pressure surface 28 of the diffuser vane 10 with respect to the radial direction ($0° \leq \beta \leq 90°$) (that is, an angle formed by the aforementioned tangent line LT with respect to a radial straight line $LR_{TE}$ passing through the trailing edge 26).

More specifically, as shown in FIGS. 2A and 2B, the plurality of diffuser vanes 10 include at least one first diffuser vane 11 positioned at least partially in an angular range $A_1$ (see FIG. 2A) between the tongue section 22 of the scroll portion 8 and the scroll end 8*b* of the scroll portion 8, and the second diffuser vanes 12 positioned in an angular range other than the angular range A1.

Then, a vane outlet angle β1 of the first diffuser vane 11 (see FIG. 2B) and a vane outlet angle β2 of the second diffuser vane 12 (see FIG. 2B) satisfy the relation of $\beta 1 < \beta 2$.

Figure 6:
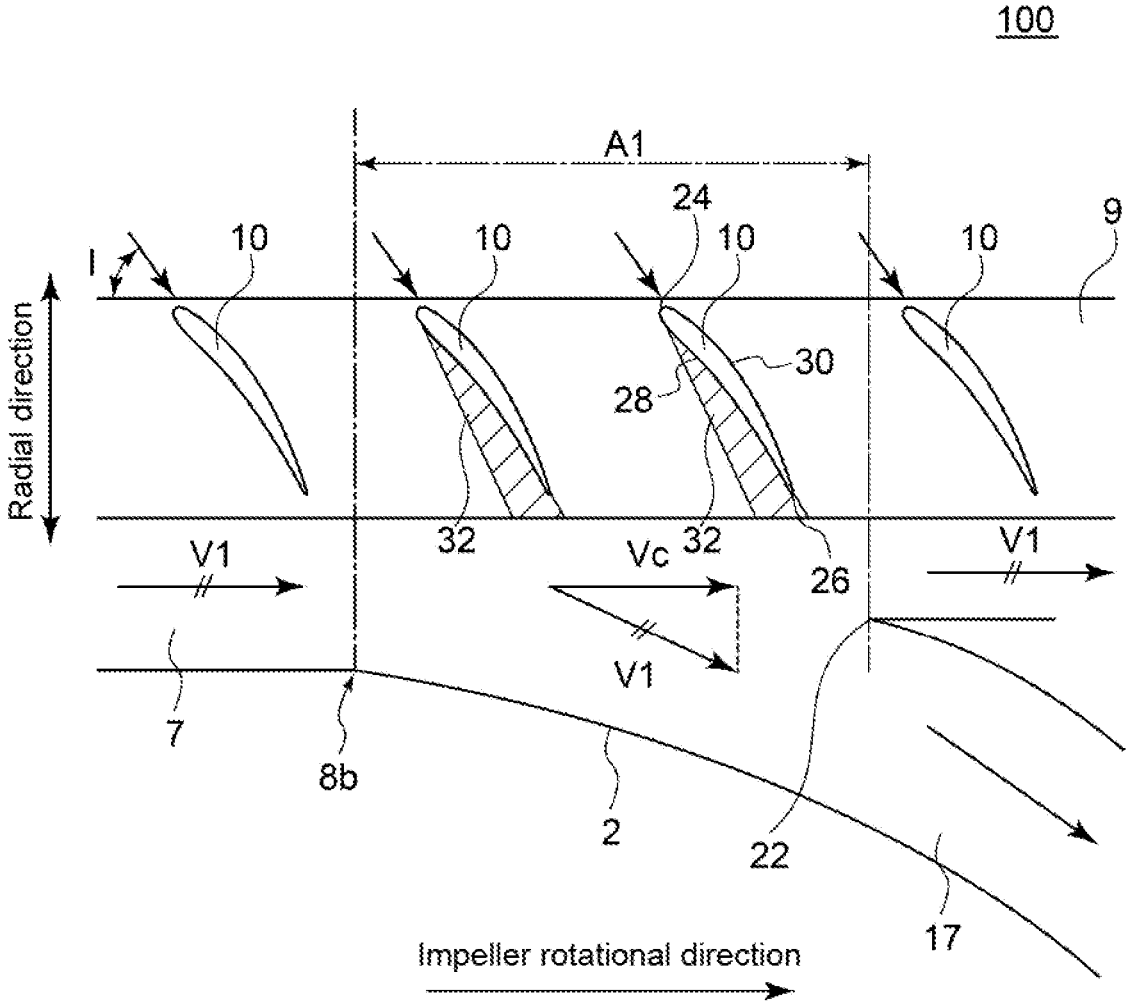
FIG. 6 is a schematic view showing the configuration of a typical centrifugal compressor 100.

FIG. 6 is a schematic view showing the configuration of a typical centrifugal compressor 100, and is a view showing a linear vane-arrangement mapping of the diffuser vanes 10, of the plurality of diffuser vanes 10, positioned in the above-described angular range $A_1$ (that is, the angular range between the tongue section 22 and the scroll end 8*b* of the scroll portion 8) and in the vicinity thereof, and the scroll flow passage 7 and the outlet flow passage 17 corresponding to the linear vane-arrangement mapping.

In the typical centrifugal compressor 100 shown in FIG. 6, the plurality of diffuser vanes 10 each have the same shape and are uniformly arranged at intervals in the circumferential direction. That is, the plurality of diffuser vanes 10 respectively have the above-described vane outlet angles β and angles (stagger angles) γ, which are identical to each other. Each of the angles (stagger angles) γ is formed by a chordwise direction with respect to the radial direction.

In the angular range A1 in the vicinity of the outlet of the scroll flow passage 7 in the circumferential direction, the flow stalls on the pressure surface 28 of the diffuser vane 10 (in a region 32 of FIG. 6) (negative stall), which is likely to cause separation as compared with another angular range.

This is considered for the following reason. That is, as shown in FIG. 6, the fluid accelerated by the impeller (not shown in FIG. 6) flows into the diffuser passage 9 at an incident angle I, passes through the diffuser vanes 10, and flows into the scroll flow passage 7. A flow velocity vector $V_1$ in the scroll flow passage 7 is basically a circumferential vector. In the angular range A1 in the vicinity of the outlet of the scroll flow passage 7, a fluid flow is guided from the scroll flow passage 7 to the outlet flow passage 17, turning the direction of the fluid flow and decreasing a circumferential component Vc of the flow velocity as compared with the other angular range. Therefore, in the angular range A1 in the vicinity of the outlet of the scroll flow passage, an effect of pressing the flow in the vicinity of the diffuser vanes 10 against the pressure surface 28 by the circumferential flow in the scroll flow passage 7 is small as compared with the other angular range, which is likely to cause separation of the flow on the pressure surface 28.

In this regard, in the above-described embodiment, since the vane outlet angle β1 of the first diffuser vane 11 positioned in the angular range A1 in the vicinity of the outlet of the scroll flow passage 7 is smaller than the vane outlet angle β2 of the second diffuser vane 12 positioned outside the angular range A1, the pressure surface 28 in the vicinity of the trailing edge 26 of the first diffuser vane 11 is positioned upstream in the rotational direction of the impeller 4 as compared with the second diffuser vane 12 (see a second diffuser vane 12' indicated by a dashed line in FIG. 2B). Therefore, it is possible to suppress separation on the side of the pressure surface 28 of the first diffuser vane 11.

The second diffuser vane 12' shown in FIG. 2B is a virtual diffuser vane illustrated for comparison of the shape and the like with the first diffuser vane 11, and is shown by rotary-moving about the rotational axis O of the centrifugal compressor 1 so that the position of the leading edge 24 of the second diffuser vane 12 positioned outside the angular range A1 overlaps the first diffuser vane 11.

If the plurality of diffuser vanes 10 positioned at least partially in the above-described angular range A1 exist, only some of the diffuser vanes 10 may be the first diffuser vanes 11 (that is, the diffuser vanes each having the vane outlet angle β1 satisfying the above-described relation of $\beta 1 < \beta 2$).

Some embodiments of the centrifugal compressor in which the vane outlet angle β1 of the first diffuser vane 11 and the vane outlet angle β2 of the second diffuser vane 12 satisfy the relation of $\beta 1 < \beta 2$ will be described below in more detail.

Figure 3:
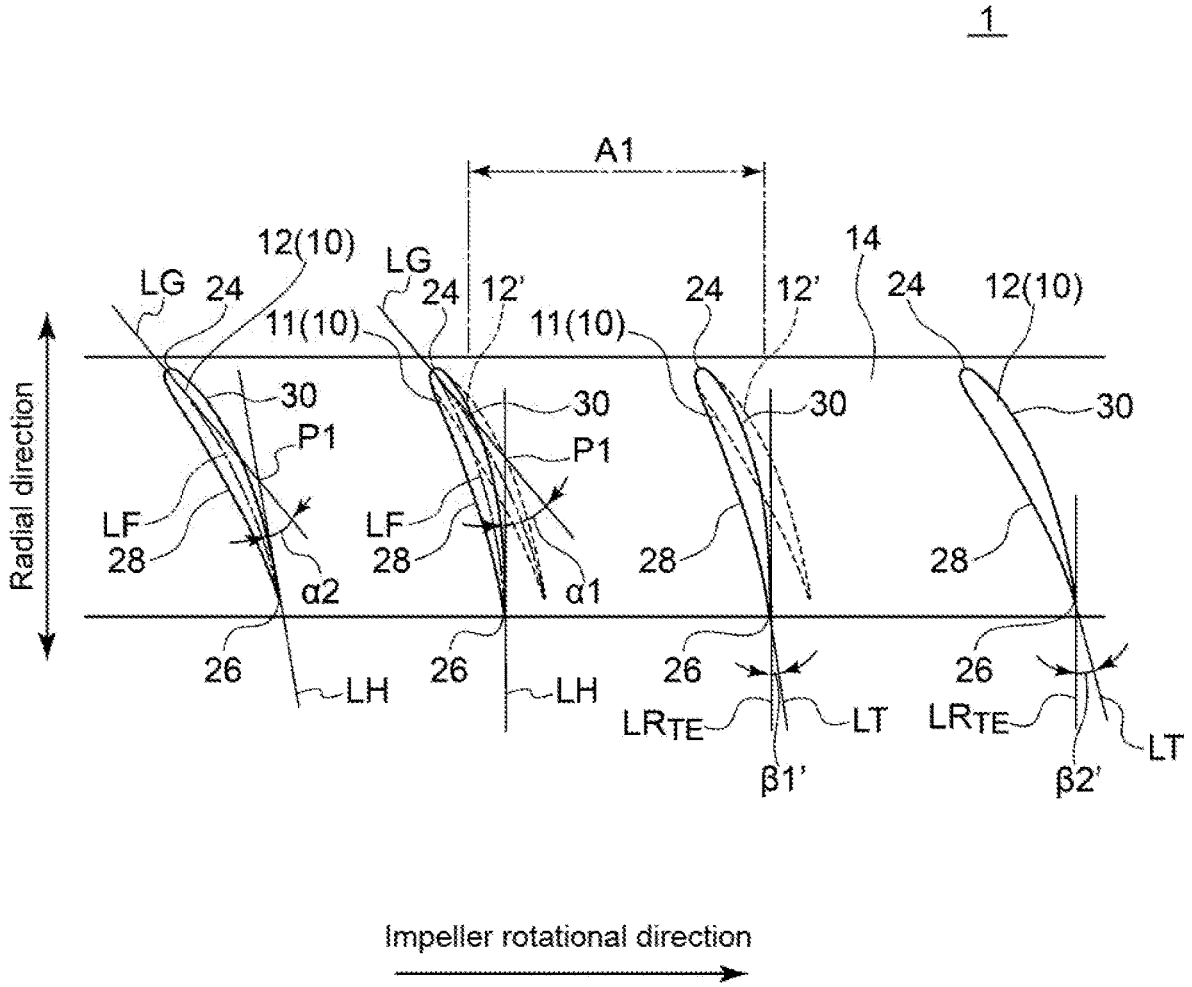
FIG. 3 is a view showing the configuration of diffuser vanes in the centrifugal compressor according to an embodiment.
Figure 4:
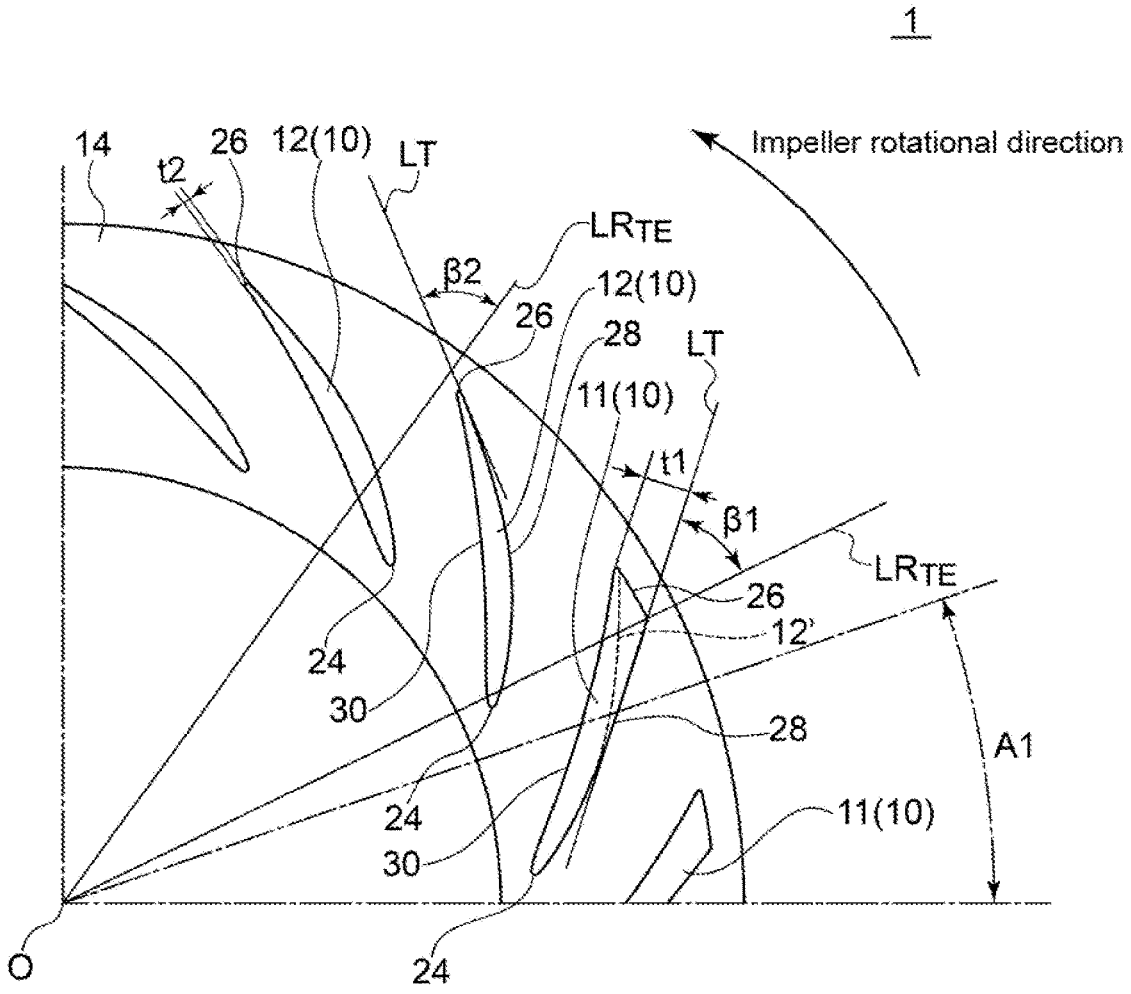
FIG. 4 is a view showing the configuration of the diffuser vanes in the centrifugal compressor according to an embodiment.
Figure 5:
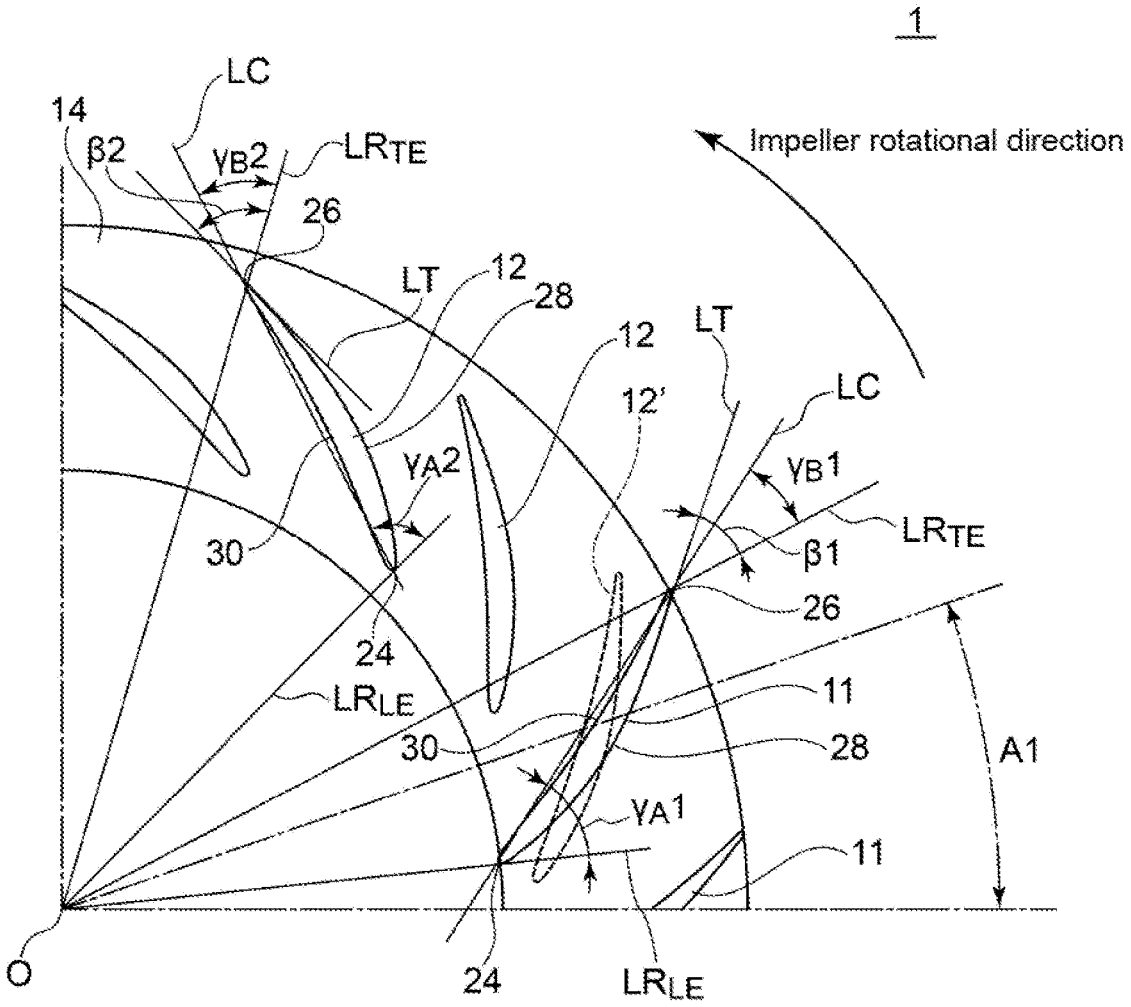
FIG. 5 is a view showing the configuration of the diffuser vanes in the centrifugal compressor according to an embodiment.

Each of FIGS. 3 to 5 is a view showing the configuration of the diffuser vanes 10 in the centrifugal compressor according to an embodiment. FIG. 3 is a view showing the linear vane-arrangement mapping of the diffuser vanes 10, of the plurality of diffuser vanes 10 (including the first diffuser vanes 11 and the second diffuser vanes 12) of the centrifugal compressor 100, positioned in the above-described angular range $A_1$ (that is, the angular range between the tongue section 22 and the scroll end 8*b* of the scroll portion 8) and in the vicinity thereof according to an embodiment. Each of FIGS. 4 and 5 is a view of the diffuser vanes 10 positioned in the above-described angular range A1 and in the vicinity thereof in the centrifugal compressor as viewed from the axial direction according to an embodiment.

In FIGS. 3 and 5, the components other than the diffuser vanes 10 and the mounting plate 14 are not shown. Moreover, each second diffuser vane 12' shown in FIGS. 3 to 5 is the virtual diffuser vane illustrated for comparison of the shape and the like with the first diffuser vane 11, and is shown by rotary-moving about the rotational axis O so that the position of the leading edge 24 of the second diffuser vane 12 positioned outside the angular range A1 overlaps the first diffuser vane 11.

In an embodiment, for example, as shown in FIG. 3, on the linear vane-arrangement mapping of the plurality of diffuser vanes 10, a camber angle $\alpha 1$ of the first diffuser vane 11 positioned at least partially in the angular range A1 and a camber angle $\alpha 2$ of the second diffuser vane 12 positioned outside the angular range A1 satisfy $\alpha 1>\alpha 2$.

A camber angle $\alpha$ of each of the diffuser vanes 10 is an angle formed between a tangent line LG at the leading edge 24 and a tangent line LH at the trailing edge 26 of a camber line LF of each of the diffuser vanes 10. Provided that P1 is an intersection point between the tangent line LG at the leading edge 24 and the tangent line LH at the trailing edge 26 described above, the camber angle $\alpha$ is an angle between a vector in a direction from the leading edge 24 toward the intersection point P1 and a vector in a direction from the intersection point P1 toward the trailing edge 26 ($0° \leq \alpha \leq 180°$) (see FIG. 3).

Thus, since the camber angle $\alpha 1$ of the first diffuser vane 11 is larger than the camber angle $\alpha 2$ of the second diffuser vane 12, the pressure surface 28 of the first diffuser vane 11 deviates upstream in the impeller rotational direction with reference to the leading edge 24, as compared with the second diffuser vane 12 (see the second diffuser vanes 12' each indicated by the dashed line in FIG. 3). Thus, it is possible to achieve the configuration in which the vane outlet angle $\beta 1$ of the first diffuser vane 11 and the vane outlet angle $\beta 2$ of the second diffuser vane 12 satisfy the relation of $\beta 1<\beta 2$.

FIG. 3 shows a vane outlet angle $\beta 1'$ of the first diffuser vane 11 and a vane outlet angle $\beta 2'$ of the second diffuser vane 12 in the linear vane-arrangement mapping. The magnitude relationship between the vane outlet angle $\beta 1'$ and the vane outlet angle $\beta 2'$ in the linear vane-arrangement mapping is the same as the magnitude relationship between the vane outlet angle $\beta 1$ and the vane outlet angle $\beta 2$. That is, in the linear vane-arrangement mapping of the diffuser vanes, the relation of $\beta 1<\beta 2$ is also satisfied as long as $\beta 1'<\beta 2'$ holds.

In an embodiment, for example, as shown in FIG. 4, a vane thickness t1 at the trailing edge 26 of the first diffuser vane 11 and a vane thickness t2 at the trailing edge 26 of the second diffuser vane 12 satisfy t1>t2.

In the exemplary embodiment shown in FIG. 4, while the suction surface 30 of the first diffuser vane 11 has the same shape as the suction surface 30 of the second diffuser vane 12, the pressure surface 28 of the first diffuser vane 11 deviates upstream in the impeller rotational direction as compared with the second diffuser vane 12. That is, a distance (vane thickness t) between the pressure surface 28 and the suction surface 30 of the first diffuser vane 11 has a special vane thickness distribution increasing from the side of the leading edge 24 toward the side of the trailing edge 26.

Since the vane thickness t1 at the trailing edge 26 of the first diffuser vane 11 is thus larger than the vane thickness t2 at the trailing edge 26 of the second diffuser vane 12, it is possible to deviate the pressure surface 28 of the first diffuser vane 11 upstream in the impeller rotational direction without greatly changing the position of the suction surface 30 of the first diffuser vane 11, as compared with the second diffuser vane 12 (see the second diffuser vane 12' indicated by the dashed line in FIG. 4). Thus, it is possible to achieve the configuration in which the vane outlet angle $\beta 1$ of the first diffuser vane 11 and the vane outlet angle $\beta 2$ of the second diffuser vane 12 satisfy the relation of $\beta 1<\beta 2$.

In an embodiment, for example, as shown in FIG. 5, the stagger angle $\gamma$ formed by the chordwise direction of each of the plurality of diffuser vanes 10 with respect to the radial direction satisfies $\gamma 1>\gamma 2$, where $\gamma 1$ is a stagger angle of the first diffuser vane 11, and $\gamma 2$ is a stagger angle of the second diffuser vane 12.

The stagger angle $\gamma$ is an angle formed by the chordwise direction (a direction of a straight line passing through the leading edge 24 and the trailing edge 26) of each of the diffuser vanes 10 with respect to the radial direction ($0° \leq \gamma \leq 90°$).

The above-described stagger angle $\gamma$ may be a stagger angle $\gamma_A$ with reference to the leading edge 24 or a stagger angle $\gamma_B$ with reference to the trailing edge 26 of each of the diffuser vanes 10. The stagger angle $\gamma_A$ with reference to the leading edge 24 of each of the diffuser vanes 10 is an angle between a straight line Lc in the chordwise direction of each of the diffuser vanes 10 and a radial straight line passing through the leading edge 24 of each of the diffuser vanes 10 (see FIG. 5). Moreover, the stagger angle $\gamma_B$ with reference to the trailing edge 26 of each of the diffuser vanes 10 is an angle between a straight line Lc in the chordwise direction of each of the diffuser vanes 10 and a radial straight line passing through the trailing edge 26 of each of the diffuser vanes 10 (see FIG. 5).

In the exemplary embodiment shown in FIG. 5, a stager angle $\gamma_A 1$ with reference to the leading edge 24 of the first diffuser vane 11 is smaller than a stagger angle $\gamma_A 2$ with reference to the leading edge 24 of the second diffuser vane 12 (that is, $\gamma_A 1<\gamma_A 2$ is satisfied).

Moreover, in the exemplary embodiment shown in FIG. 5, a stager angle $\gamma_B 1$ with reference to the trailing edge 26 of the first diffuser vane 11 is smaller than a stagger angle $\gamma_B 2$ with reference to the trailing edge 26 of the second diffuser vane 12 (that is, $\gamma_B 1<\gamma_B 2$ is satisfied).

Thus, since the stagger angle $\gamma 1$ ($\gamma_A 1$ or $\gamma_B 1$) of the first diffuser vane 11 is smaller than the stagger angle $\gamma 2$ ($\gamma_A 2$ or $\gamma_B 2$) of the second diffuser vane 12, the pressure surface 28 of the first diffuser vane 11 deviates upstream in the impeller rotational direction with reference to the leading edge 24, as compared with the second diffuser vane 12 (see the second diffuser vanes 12' indicated by the dashed line in FIG. 5). Thus, it is possible to achieve the configuration in which the vane outlet angle $\beta 1$ of the first diffuser vane 11 and the vane outlet angle $\beta 2$ of the second diffuser vane 12 satisfy the relation of $\beta 1<\beta 2$.

Furthermore, in the exemplary embodiment shown in FIG. 5, in a cross section orthogonal to the axial direction, the cross-sectional shape of the first diffuser vane 11 is the same as the cross-sectional shape of the second diffuser vane 12.

Since the stagger angle $\gamma 1$ of the first diffuser vane 11 and the stagger angle $\gamma 2$ of the second diffuser vane satisfy the relation of $\gamma 1<\gamma 2$, it is possible to achieve the configuration in which the vane outlet angle $\beta 1$ of the first diffuser vane 11 and the vane outlet angle $\beta 2$ of the second diffuser vane 12 satisfy $\beta 1<\beta 2$, even if the first diffuser vane having the common cross-sectional shape with the second diffuser vane 12 is adopted as in the exemplary embodiment shown in FIG. 5.

Embodiments of the present invention were described in detail above, but the present invention is not limited thereto, and various amendments and modifications may be implemented.

Further, in the present specification, an expression of relative or absolute arrangement such as "in a direction", "along a direction", "parallel", "orthogonal", "centered", "concentric" and "coaxial" shall not be construed as indicating only the arrangement in a strict literal sense, but also includes a state where the arrangement is relatively displaced by a tolerance, or by an angle or a distance whereby it is possible to achieve the same function.

For instance, an expression of an equal state such as "same" "equal" and "uniform" shall not be construed as indicating only the state in which the feature is strictly equal, but also includes a state in which there is a tolerance or a difference that can still achieve the same function.

Further, for instance, an expression of a shape such as a rectangular shape or a cylindrical shape shall not be construed as only the geometrically strict shape, but also includes a shape with unevenness or chamfered corners within the range in which the same effect can be achieved.

As used herein, the expressions "comprising", "containing" or "having" one constitutional element is not an exclusive expression that excludes the presence of other constitutional elements.

REFERENCE SIGNS LIST

1 Centrifugal compressor
2 Rotational shaft
4 Impeller
5 Rotor blade
6 Housing
7 Scroll flow passage
8 Scroll portion
9 Diffuser passage
10 Diffuser vane
11 First diffuser vane
12 Second diffuser vane
14 Mounting plate
16 Outlet portion
17 Outlet flow passage
18 Hub-side wall surface
20 Shroud-side wall surface
22 Tongue section
24 Leading edge
26 Trailing edge
28 Pressure surface
30 Suction surface
32 Region
O Rotational axis
t1, t2 Vane thickness at trailing edge
$\alpha$1, $\alpha$2 Camber angle
$\beta$1, $\beta$1' Vane outlet angle
$\gamma$1, $\gamma$2 Stager angle
$\gamma_A$1, $\gamma_A$2 Stager angle with reference to leading edge
$\gamma_B$1, $\gamma_B$2 Stager angle with reference to trailing edge

The invention claimed is:

1. A centrifugal compressor, comprising: an impeller;

a plurality of diffuser vanes arranged in a circumferential direction on a radially outer side of the impeller; and a housing which includes a scroll portion forming a scroll flow passage positioned on a radially outer side of the plurality of diffuser vanes, wherein the plurality of diffuser vanes include:

at least one first diffuser vane positioned at least partially in an angular range between a tongue section of the scroll portion and a scroll end of the scroll portion in the circumferential direction; and a second diffuser vane positioned outside the angular range, wherein a vane outlet angle formed by a tangent line at a trailing edge to a pressure surface of each of the plurality of diffuser vanes satisfies $\beta 1<\beta 2$, where $\beta 1$ is the vane outlet angle of the first diffuser vane, and $\beta 2$ is the vane outlet angle of the second diffuser vane, and wherein, on a linear vane-arrangement mapping of the plurality of diffuser vanes, a camber angle $\alpha 1$ of the first diffuser vane and a camber angle $\alpha 2$ of the second diffuser vane satisfy $\alpha 1>\alpha 2$.

2. The centrifugal compressor according to claim 1, wherein a stagger angle formed by a chordwise direction of each of the plurality of diffuser vanes with respect to the radial direction satisfies $\gamma 1<\gamma 2$, where $\gamma 1$ is the stagger angle of the first diffuser vane, and $\gamma 2$ is the stagger angle of the second diffuser vane.

3. The centrifugal compressor according to claim 2, wherein, in a cross section orthogonal to an axial direction, the first diffuser vane has the same cross-sectional shape as the second diffuser vane.

4. The centrifugal compressor according to claim 1, wherein the vane outlet angle $\beta 1$ of each of the first diffuser vanes is smaller than the vane outlet angle $\beta 2$ of each of all the second diffuser vanes positioned outside the angular range.

5. The centrifugal compressor according to claim 1, wherein the plurality of diffuser vanes have an arrangement center which is coincident with a rotational center of the impeller.

6. The centrifugal compressor according to claim 1, wherein an angle formed by the tangent line at the trailing edge to the pressure surface of each of the plurality of diffuser vanes with respect to a straight line extending from an arrangement center of the plurality of diffuser vanes to the trailing edge of each of the diffuser vanes is larger in the first diffuser vane than in the second diffuser vane.

7. A turbocharger, comprising:

the centrifugal compressor according to claim 1.

8. A centrifugal compressor, comprising:

an impeller;

a plurality of diffuser vanes arranged in a circumferential direction on a radially outer side of the impeller; and a housing which includes a scroll portion forming a scroll flow passage positioned on aradially outer side of the plurality of diffuser vanes, wherein the plurality of diffuser vanes include:

at least one first diffuser vane positioned at least partially in an angular range between a tongue section of the scroll portion and a scroll end of the scroll portion in the circumferential direction; and a second diffuser vane positioned outside the angular range, wherein a vane outlet angle formed by a tangent line at a trailing edge to a pressure surface of each of the plurality of diffuser vanes satisfies $\beta 1<\beta 2$, where $\beta 1$ is the vane outlet angle of the first diffuser vane, and $\beta 2$ is the vane outlet angle of the second diffuser vane, and wherein a vane thickness t1 at the trailing edge of the first diffuser vane and a vane thickness t2 at the trailing edge of the second diffuser vane satisfy t1>t2.

9. A turbocharger, comprising:

the centrifugal compressor according to claim 8.

* * * * *